US005481950A

United States Patent [19]

Browning

[11] Patent Number: 5,481,950

[45] Date of Patent: Jan. 9, 1996

[54] MULTIPURPOSE TOOL FOR USE WITH RAILROAD CARS

[75] Inventor: Don R. Browning, Salem, Va.

[73] Assignee: Norfolk Southern Railway Co., Norfolk, Va.

[21] Appl. No.: 231,477

[22] Filed: Apr. 22, 1994

[51] Int. Cl.[6] ..... B25B 33/00

[52] U.S. Cl. ..... 81/488; 7/145; 7/166; 81/176.1

[58] Field of Search ..... 81/488, 176.1, 81/176.15, 176.2; 254/44, 113–114, 117, 119–121, 129, 131; 7/166, 169–170, 145, 138

[56] References Cited

U.S. PATENT DOCUMENTS

| | | | |
|---|---|---|---|
| 684,858 | 10/1901 | Pearson | 7/145 X |
| 872,271 | 11/1907 | Benet | 7/145 |
| 4,646,378 | 3/1987 | Borden | 7/166 X |
| 4,715,252 | 12/1987 | Pella | 81/176.1 |
| 4,991,469 | 2/1991 | Pella | 81/176.1 X |

*Primary Examiner*—D. S. Meislin
*Attorney, Agent, or Firm*—Watson, Cole, Grindle & Watson

[57] ABSTRACT

A rigid head extending laterally from an adjustable handle has an elongate slot therethrough aligned with the longitudinal axis, of the handle for receiving and operating the handle of a valve. A first concave surface is formed in the upper edge of the head for pushing on the spokes of a brake wheel. The first concave surface has opposite ends of similar slope approaching ninety degrees relative to the upper edge for pushing on the spokes of a brake wheel and preventing kick-out of the tool from the brake wheel. A second concave surface is formed in the lower edge of the head for pulling on the spokes of a brake wheel. A first end of the second concave surface has a slope approaching ninety degrees relative to the lower edge. An opposite end of the second concave surface adjacent the outer edge of the head has a slope relative to the lower edge of the head which is significantly less than the slope of the first end to facilitate kick-out of the tool while the brake wheel is in motion. The second concave surface slopes to a point where it joins the outer edge of the head to define a point adapted to fit within a hole in a knuckle of a railroad car.

3 Claims, 1 Drawing Sheet

MULTIPURPOSE TOOL FOR USE WITH RAILROAD CARS

BACKGROUND OF THE INVENTION

The tool of the present invention is particularly adapted for use with railroad cars such as a coal hopper car which has a brake wheel mounted on one end thereof for manually setting and releasing the handbrake of the car. The brake wheel is nearly always mounted so that it is above the head of a crewman walking trackside and mounted so that the wheel is disposed perpendicular to the ground. Rules require that a cut of cars be left with enough of the cars having their handbrakes on so as to avoid risk of a rollaway. While a cut of cars at a railyard may be adequately secured by having two per cent of the handbrakes applied, in the coal fields the requirement might be for sixty to seventy per cent of the handbrakes to be applied.

In order to properly set and release such handbrakes, a crewman must mount the car, ascend a ladder on the side of the car, step to a ladder at the end of the car so that he is then between adjacent cars, place one foot on the brake platform, grasp a rung of the end ladder with one hand and then operate the handbrake with the free hand. After setting or releasing the handbrake, the crewman must step back to the end ladder, step to the side ladder, descend the side ladder and then dismount from the car. The crewman is also required to climb the ladder only on that side of the car on which the brake wheel is located. Therefore, if the handbrake to be operated is on the opposite side of the car from where the crewman is standing, he must cross between the cars which is very dangerous or he must walk completely around the cut of cars.

It is apparent that the above procedures for setting and releasing handbrakes is very time consuming. Furthermore, it can be quite hazardous. If the crewman crosses between adjacent cars, he must place himself between the cars for an extended period of time and must step on safety appliances which were never intended to be steps. If the appliances do not function properly or if the equipment is wet and slippery, the crewman could be injured. If the cut of cars should move unexpectedly while the crewman is mounting or climbing the car or when he is between cars, the results could be disastrous.

Accordingly, an important objective of the invention is to provide a tool which will permit a crewman to set or release a handbrake without having either to climb the equipment or cross between cars. In other words, the crewman can operate the handbrake while standing on the ground without stepping in the gauge of the railroad tracks and without going between cars. This will increase the efficiency of operating the handbrakes and will also result in lowering the incidence of injuries to crewmen during such operations.

In addition to operating the handbrakes, the crewman may also need to operate a retainer valve usually mounted on the same end of railroad cars as the handbrake. A retainer valve is a mechanically operated valve which controls the operation of the air brakes of the railroad car. If there is air in the brake tanks of the car, the air brakes can be left on or can be released at a desired rate by the retainer valve. The process for operating retainer valves is similar to that involved in operating the handbrakes since a crewman must mount the car, climb the side ladder and hang on to a rung of the ladder with one hand while operating the valve with his free hand. This procedure has the same drawbacks as the procedure for operating the handbrakes. Here again, it is desirable to provide a tool which will enable a crewman to operate the retainer valve while standing on the ground without stepping in the gauge of the tracks and without placing himself between cars.

A still further duty of a crewman is to open and close knuckles of the coupling mechanism used to connect adjacent cars. In the past, erewman have stepped in the gauge of the tracks to operate the knuckles. It is therefore also desirable that the tool enables a crewman to operate such knuckles while standing on the ground outside of the gauge of the tracks.

SUMMARY OF THE INVENTION

The present invention provides a multipurpose tool which enables a crewman to operate the brake wheel, the retainer valve and the knuckle of a railroad car in a simple and effective manner while standing on the ground outside of the gauge of the tracks.

The tool includes an elongated conventional handle having a longitudinal axis and including a plurality of telescoping sections which incorporate a well-known cam-lock device for locking the sections in adjusted position so as to permit quick and easy extension or collapse of the handle sections. The handle can be locked in any convenient length by twisting one section relative to the adjacent section in one direction or the other to lock and unlock the adjacent sections relative to one another.

A rigid head is attached to the handle and extends laterally therefrom. The head includes a first generally concave surface on the upper edge thereof for receiving a spoke of a brake wheel, and the lower edge of the head includes a second generally concave surface which is also adapted to receive a spoke of a brake wheel. The tool also includes an elongated slot formed therethrough having a longitudinal axis substantially aligned with the longitudinal axis of the handle. This slot is adapted to receive the handle of a retainer valve so that the valve can be operated by the tool.

The slope of the concave surface on the lower edge of the head has a slope at one end thereof adjacent the outer edge which is less than the slope at the other end thereof adjacent the lower edge to facilitate kick-out of the tool away from a brake wheel when pulling on the brake wheel. The tool is used to operate the brake wheel by inserting the head of the tool from the outer side of the wheel away from the associated car between the spokes of a brake wheel so that a spoke of the brake wheel is received in the concave surface on the lower edge of the head. As the tool is pulled downwardly, the spoke of the wheel will be moved downwardly and will tend to move outwardly away from the axis of handle along the last-mentioned concave surface. This is beneficial since the leverage and force on the wheel increases due to the increase in the moment arm of the force applied to the wheel. Additionally, when pulling down in a series of short pulls on the tool, it is desirable to have the head kick-out of engagement with the wheel so that the head can be reinserted at a different point on the brake wheel. The slope of this concave surface facilities such kick-out.

When a brake wheel is initially released, considerable tension is on the brake chain connected to the wheel. Therefore, it is difficult to initially move the brake wheel. The head may be used to hammer the wheel with considerable force to loosen the brake wheel. The tool may then be used for several quick pulls on the wheel to further loosen the brake wheel. When the brakewheel is loosened, the tool may be used to spin the wheel through a number of revolutions to fully release the brakes. During this spinning procedure, the tool may remain in contact with the wheel so that the wheel can be rapidly rotated by first pulling on the tool with a spoke of the brake wheel received in the concave surface on the lower edge of the head and then pushing on the tool with a spoke of the brake wheel received in the concave surface on the upper edge of the head. The concave surface on the upper edge of the head has a similar slope at opposite ends thereof to prevent kick-out of the tool when pushing on the brake wheel.

The slope at one end of the concave surface portion of the lower edge extends to a point where it joins the outer edge of the head to that the point can be received within a hole formed within the jaw of a knuckle on a railroad car, thereby facilitating positioning of the head within the jaws of a knuckle for separating the jaws of the knuckle.

When using the tool of the invention, if the safety appliances on the car do not function properly or if the weather is inclement and the equipment is wet and slippery, it does not matter since the crewman does not mount, dismount or climb on the car. If the cut of cars moves unexpectedly, the crewman is not between cars and is standing to the side clear of all movement. If the brakewheel is on the opposite side of the car from the crewman, the tool can be adjusted to be long enough to permit the crewman to reach a brake wheel on the opposite side of the car. Another advantage of the tool is that a crewman is not required to take a very large initial step upwardly in trying to mount a car located on a track where the ballast is steep.

DESCRIPTION OF THE PREFERRED EMBODIMENT

Figures 1, 2, 3, 4, 5, 6:
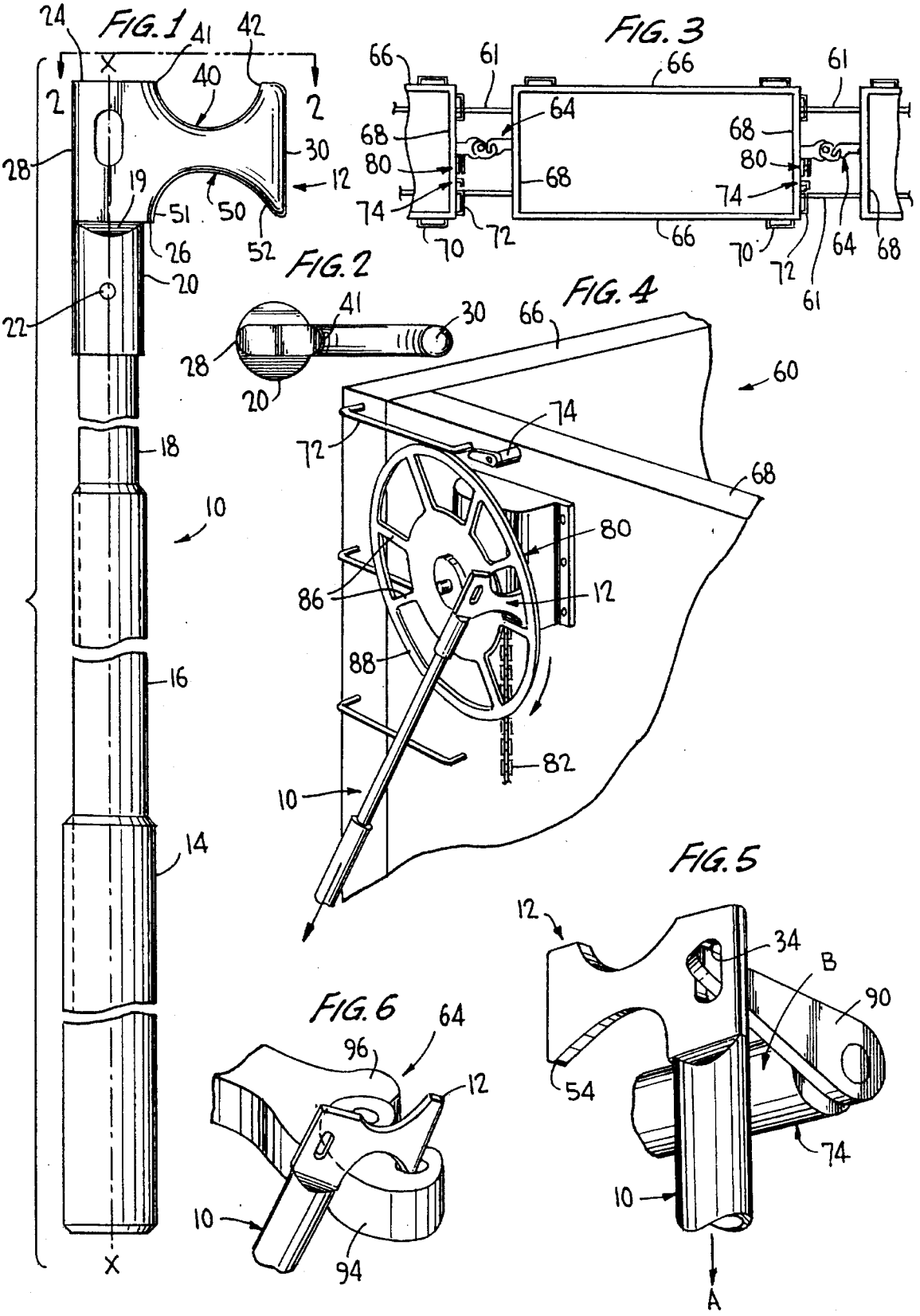
FIG. 1 is an elevation, partly broken away, of a tool according to the present invention.
FIG. 2 is a top view taken along line 2—2 of FIG. 1.
FIG. 3 is a top view, broken away, of a plurality of railroad cars connected to one another.
FIG. 4 is a top perspective view, broken away, of the end of a railroad car.
FIG. 5 is a perspective view showing how the tool cooperates with the handle of a valve.
FIG. 6 is a perspective view showing how the tool cooperates with a knuckle on a railroad car.

Referring now to the drawing wherein like reference characters designate corresponding parts throughout the several views, there is shown in FIG. 1 the tool of the invention which includes a handle indicated generally by numeral 10 and a rigid head indicated generally by numeral 12 attached to the upper end of the handle and extending laterally from the handle. The handle comprises three sections 14, 16 and 18 with section 18 telescopically received within section 16 and section 16 telescopically received within section 14. This handle is of conventional construction and the sections are formed of reinforced fiberglass to provide a lightweight, strong, durable and weather-resistant construction. The lower section 14 of the handle is preferably covered with a latex grip to provide a non-slip comfortable gripping surface.

The sections of the handle may be adjusted with respect to one another and are locked in position by a camlock mechanism consisting of two semicircular members made of synthetic gripping material which are adapted to be spread apart and locked against the inner wall of the handle by a steel cam. This construction is wellknown and enables the length of the tool to be adjusted by rotating one section of the tool relative to the adjacent section of the tool in one direction to unlock the camlock mechanism whereupon the desired length adjustment may be made. The adjacent sections may then be rotated relative to one another in the opposite direction to lock the sections in position.

While the handle has been shown as including three sections, it may also be made of two sections. The extended length of a tool including a three section handle may be about seven feet four inches, while the extended length of a tool including a two section handle may be about seven feet ten inches. The collapsed length of a tool including a three section handle may be about thirty-eight inches, while the collapsed length of a tool including a two section handle may be about fifty-two inches. The advantage of the three section handle is that the tool may more readily be carried by a crewman.

The head 12 may be formed of aluminum and may have a thickness of about one-half inch. The head is welded at 19 to a tubular piece of aluminum 20 which is fitted over the upper end of section 18. A solid plastic insert (not shown) is disposed within the upper hollow end of section 18 of the handle, and a rivet 22 passes through aligned holes in member 20, the upper end of member 18 and the plastic insert disposed within the upper end of member 18 to attach the head to the upper end of the handle.

The head includes an upper edge 24, a lower edge 26, an inner edge 28 and an outer edge 30. The handle includes a central longitudinal axis X—X, and it will be noted that the inner edge 28 is disposed adjacent axis X—X, while the outer edge 30 is spaced laterally away from axis X—X. The head has an elongated slot 34 formed therethrough for receiving the handle of a retainer valve hereinafter described. The slot has a longitudinal axis which is substantially aligned with axis X—X so that movement of the tool in a particular direction will cause a similar movement of the valve handle without applying any twisting moment to the handle which would be the case if the longitudinal axis of the slot were not substantially aligned with axis X—X.

As seen in FIG. 1, the upper edge 24 is provided with a generally concave surface portion 40 having opposite ends 41 and 42 which have similar slope which approaches 90 degrees with respect to horizontal at the point where these opposite ends join the upper edge 24 of the head. Concave surface portion 40 is adapted to receive a spoke of a brake wheel when pushing upward against the spoke of the brake wheel while rapidly spinning a brake wheel. The slope of the end 42 prevents kick-out of the tool from a brake wheel when pushing on the brake wheel, or in other words, the head of the tool will not move horizontally as seen in FIG. 1 so as to disengage from the spoke of a brake wheel with which it is in contact.

The lower edge 26 of the head is provided with a generally concave surface portion 50 having opposite ends 51 and 52. End 51 has a slope approaching ninety degrees with respect to horizontal at the point where this end joins the lower edge of the head. End 52 of surface portion 50 has a slope less than the slope of end 51, and as shown in FIG. 1 may form an angle of about thirty-eight degrees with respect to horizontal. End 52 slopes to a point 54 where it joins outer edge 30, and this point is adapted to cooperate with a knuckle on a railroad car to facilitate opening of the knuckle. The slope at the end 52 of surface 50 produces a force when pulling on the tool which causes the tool to move horizontally to the left as seen in FIG. 1 which facilitates kick-out of the tool from a brake wheel when pulling on the spoke of the brake wheel.

In a typical example, the head may have an overall length of about three and three-quarters inches, while the height thereof may be about two and one-quarter inches. The slot may have a height of about one inch and a width of about one-half inch. The surfaces 40 and 50 as well as the outer edge 30 of the head may be rounded from front to back with a radius of about one-quarter inch.

Referring to FIG. 3, a plurality of typical coal hopper cars 60 are shown on tracks 61 and are coupled to one another by conventional coupling means 64. Each car includes side walls 66 and end walls 68. A conventional side ladder 70 is mounted on a side wall and a conventional end ladder 72 is mounted on the end wall, each ladder comprising a plurality of vertically spaced rungs in the usual manner. A retainer valve 74 is mounted on the end wall 68 adjacent the top of the end ladder. A conventional brake wheel 80 is mounted on the end wall 68 of each car and is connected by the usual brake chain 82 to the handbrake of the car. The brake wheel includes a hub portion 84 which is connected by a plurality of spaced spokes 86 to the rim 88 of the wheel.

When it is desired to either set or release the brake, the tool of the invention is first adjusted to the desired length by manipulating the sections of the handle in a conventional manner, whereupon the handle is locked in place. Except when spinning the wheel when it is relatively free wheeling, the tool is used only by pulling on the brake wheel and not by pushing on the wheel. As seen in FIG. 3, the head 12 of the tool is engaged with the brake wheel at the angle formed by a spoke and the inside of the wheel rim with the spoke received in the concave surface portion formed in the lower edge of the tool head. It is noted that the point of contact of the spoke with the concave surface portion of the tool head is spaced laterally of the handle so as to provide a moment arm for applying greater force to the brake wheel. The head of the tool is always inserted from the side of the brake wheel remote from the end wall 68 and never from the opposite side of the brake wheel.

In order to set a handbrake, if the crewman is on the brake side of the car, the head of the tool is hooked onto a spoke in the three o'clock to the six o'clock position on the brake wheel. If the crewman is on the opposite side of the car, the head of the tool is hooked onto a spoke in the twelve o'clock to the three o'clock position on the brake wheel. If there is no brake tension, the wheel can be spun until tension is on the brake chain. This can be done either continuously or with short strokes allowing the tool to kick out between strokes. When tension is on the brake chain, the final braking effort is made with short pulling strokes. As tension increases and more effort is required, the crewman rocks back on his rear foot to put his body weight into the pulling action.

In order to release a handbrake, if the crewman is on the brake side of the car, the head of the tool is hooked onto a spoke in the nine o'clock or ten o'clock position on the brake wheel. If the crewman is on the opposite side of the car, the head of the tool is hooked onto a spoke in the seven o'clock or eight o'clock position on the brake wheel. A short, firm pull is then applied to the tool to release the brake. If the brake is tight and will not release, a hammering motion will make the brake release. When there is no longer any tension on the brake chain, the wheel can be spun continuously or in short strokes allowing the tool to kick out between strokes.

When a high or opposite side brake wheel is to be operated, the handle is extended to its maximum length. When a low brake wheel is to be operated, only one section of the handle may need to be extended and locked in position.

Referring to FIG. 5, the tool is illustrated in position to operate a retainer valve. The valve 74 includes a handle portion 90 which is received in slot 34 of the head of the tool. When the handle 10 of the tool is moved downwardly as indicated by the arrow A, the handle of the valve will be rotated in the direction of arrow B as shown in this figure. It is apparent that upward movement of the tool will cause the handle 90 to rotate in the opposite direction.

Referring to FIG. 6, the tool is illustrated in position to operate a knuckle of the coupling mechanism 64. The knuckle includes a jaw 94 which is pivotally connected to member 96 by a pin 98. As shown, the tool is manipulated so that the point 54 thereof, which cannot be seen in this figure, is inserted into a die hole 100 formed in the upper surface of jaw 94 so that jaw 94 can be moved into desired position.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A multipurpose tool for use with railroad cars comprising an elongated handle having a longitudinal axis, a rigid head attached to said handle and extending laterally therefrom, said head having an upper and a lower edge and an inner and an outer edge, said inner edge being disposed adjacent said longitudinal axis, said outer edge being spaced laterally away from said longitudinal axis, said head having an elongated slot formed therethrough for receiving the handle of a valve, said slot having a longitudinal axis substantially aligned with the longitudinal axis of said handle, the upper edge of said head including a first generally concave surface portion for receiving a spoke of a brake wheel, and the lower edge of said head including a second generally concave surface portion for receiving a spoke of a brake wheel, said first concave surface portion having opposite ends which have a similar slope approaching ninety degrees with respect to said upper edge where said opposite ends join said upper edge to prevent kick-out of the tool from a brake wheel when pushing on the brake wheel, said second concave surface portion including a first end adjacent said handle having a slope approaching ninety degrees with respect to said lower edge where said first end of said second concave surface portion joins said lower edge, said second concave surface portion including an opposite end adjacent said outer edge having a slope with respect to said lower edge where said opposite end of said second concave surface portion joins said lower edge which is significantly less than that of the first end of said second concave surface portion to facilitate kick-out of the tool from a brake wheel when pulling on the brake wheel, said second concave surface portion sloping to a point where it joins said outer edge so that the point is adapted to cooperate with a knuckle on a railroad car and facilitate opening of the knuckle.

2. A tool as defined in claim 1 wherein the slope of said opposite end of said second concave surface portion is less than about half the slope of said first end of said second concave surface portion.

3. A tool as defined in claim 1 wherein the slope of said opposite end of said concave surface portion of said lower edge is approximately thirty-eight degrees.

* * * * *